US008958739B2

(12) United States Patent
Murayama

(10) Patent No.: US 8,958,739 B2
(45) Date of Patent: Feb. 17, 2015

(54) PRINTING APPARATUS

(71) Applicant: Brother Kogyo Kabushiki Kaisha, Nagoya-shi, Aichi-ken (JP)

(72) Inventor: Kentaro Murayama, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 146 days.

(21) Appl. No.: 13/839,287

(22) Filed: Mar. 15, 2013

(65) Prior Publication Data

US 2014/0044467 A1 Feb. 13, 2014

(30) Foreign Application Priority Data

Aug. 10, 2012 (JP) ..... 2012-177997

(51) Int. Cl.
*G03G 15/00* (2006.01)
*G03G 15/01* (2006.01)
*G03G 21/14* (2006.01)

(52) U.S. Cl.
CPC ..... *G03G 15/6567* (2013.01)
USPC ..... 399/395; 399/394; 271/227

(58) Field of Classification Search
CPC ..... G03G 15/00; G03G 15/01; G03G 21/00; G03G 21/14
USPC ..... 399/394, 395; 271/226–255
See application file for complete search history.

(56) References Cited

U.S. PATENT DOCUMENTS

2001/0055120 A1* 12/2001 Sawada et al. ..... 358/1.9
2007/0175351 A1* 8/2007 Boness ..... 101/485
2009/0103115 A1* 4/2009 Takaki ..... 358/1.8
2009/0269089 A1* 10/2009 Nishikawa et al. ..... 399/39
2010/0119273 A1* 5/2010 Komai et al. ..... 399/395
2011/0058832 A1* 3/2011 Suzuki et al. ..... 399/49
2011/0064426 A1* 3/2011 Takeuchi ..... 399/16
2011/0158677 A1* 6/2011 Kikuchi et al. ..... 399/101
2011/0182600 A1* 7/2011 Mizuno ..... 399/39
2011/0206423 A1* 8/2011 Sugita et al. ..... 399/308
2012/0061909 A1* 3/2012 Shikama et al. ..... 271/227

FOREIGN PATENT DOCUMENTS

JP H08-262823 A 10/1996
JP 11327249 A * 11/1999 ..... G03G 15/01
JP 2003-263089 A 9/2003
JP 2004133218 A * 4/2004 ..... G03G 15/00
JP 2008-003484 A 1/2008
JP 2011008230 A * 1/2011 ..... G03G 21/00
JP 2012068429 A * 4/2012 ..... G03G 15/01

* cited by examiner

*Primary Examiner* — Nguyen Ha
(74) *Attorney, Agent, or Firm* — Merchant & Gould PC

(57) ABSTRACT

A conveying device has a conveying belt configured to convey a sheet. A printing device is configured to print an image on the sheet that is conveyed by the conveying device in a conveying direction. A plurality of sensors is arranged to be spaced away from each other in a main scanning direction that is perpendicular to the conveying direction. The plurality of sensors is configured to emit light to different detection regions on an outer peripheral surface of the conveying belt and to receive light reflected by the conveying belt. A controller is configured to execute a skew-detection-mark printing process of controlling the printing device to print a skew detection mark at positions passing the respective detection regions so that the skew detection mark extends over an end of the sheet in the conveying direction and the outer peripheral surface of the conveying belt.

14 Claims, 12 Drawing Sheets

PRINTING APPARATUS

CROSS REFERENCE TO RELATED APPLICATIONS

This application claims priority from Japanese Patent Application No. 2012-177997 filed Aug. 10, 2012. The entire content of the priority application is incorporated herein by reference.

TECHNICAL FIELD

The invention relates to technology of conveying a sheet.

BACKGROUND

Conventionally, an image forming apparatus is known that forms, on an image bearing member, an image pattern of which a portion is transferred onto a transfer medium, that detects the image pattern after the portion is transferred onto the transfer medium with toner-image detecting means, and that adjusts writing timing of an image based on the detection result.

SUMMARY

However, the above-described conventional image forming apparatus adjusts writing timing of an image, but does not allow for detection of skew of a sheet.

In view of the foregoing, it is an object of the invention to provide technology of detecting skew of a sheet.

In order to attain the above and other objects, the invention provides a printing apparatus. The printing apparatus includes a conveying device, a printing device, a plurality of sensors, and a controller. The conveying device has a conveying belt configured to convey a sheet. The conveying belt has an outer peripheral surface. The printing device is configured to print an image on the sheet that is conveyed by the conveying device in a conveying direction. The plurality of sensors is arranged to be spaced away from each other in a main scanning direction that is perpendicular to the conveying direction. The plurality of sensors is configured to emit light to different detection regions on the outer peripheral surface of the conveying belt and to receive light reflected by the conveying belt. The controller is configured to execute a skew-detection-mark printing process of controlling the printing device to print a skew detection mark at positions passing the respective detection regions so that the skew detection mark extends over an end of the sheet in the conveying direction and the outer peripheral surface of the conveying belt.

Note that the invention can be realized in various modes such as a printing system, a printing method, a print control program, a storage medium storing the print control program, and the like.

BRIEF DESCRIPTION OF THE DRAWINGS

Embodiments in accordance with the invention will be described in detail with reference to the following figures wherein.

DETAILED DESCRIPTION

First Embodiment

A printing apparatus according to a first embodiment will be described while referring to FIGS. 1 through 10.

(1) Mechanical Configuration of Printer

Figure 1:
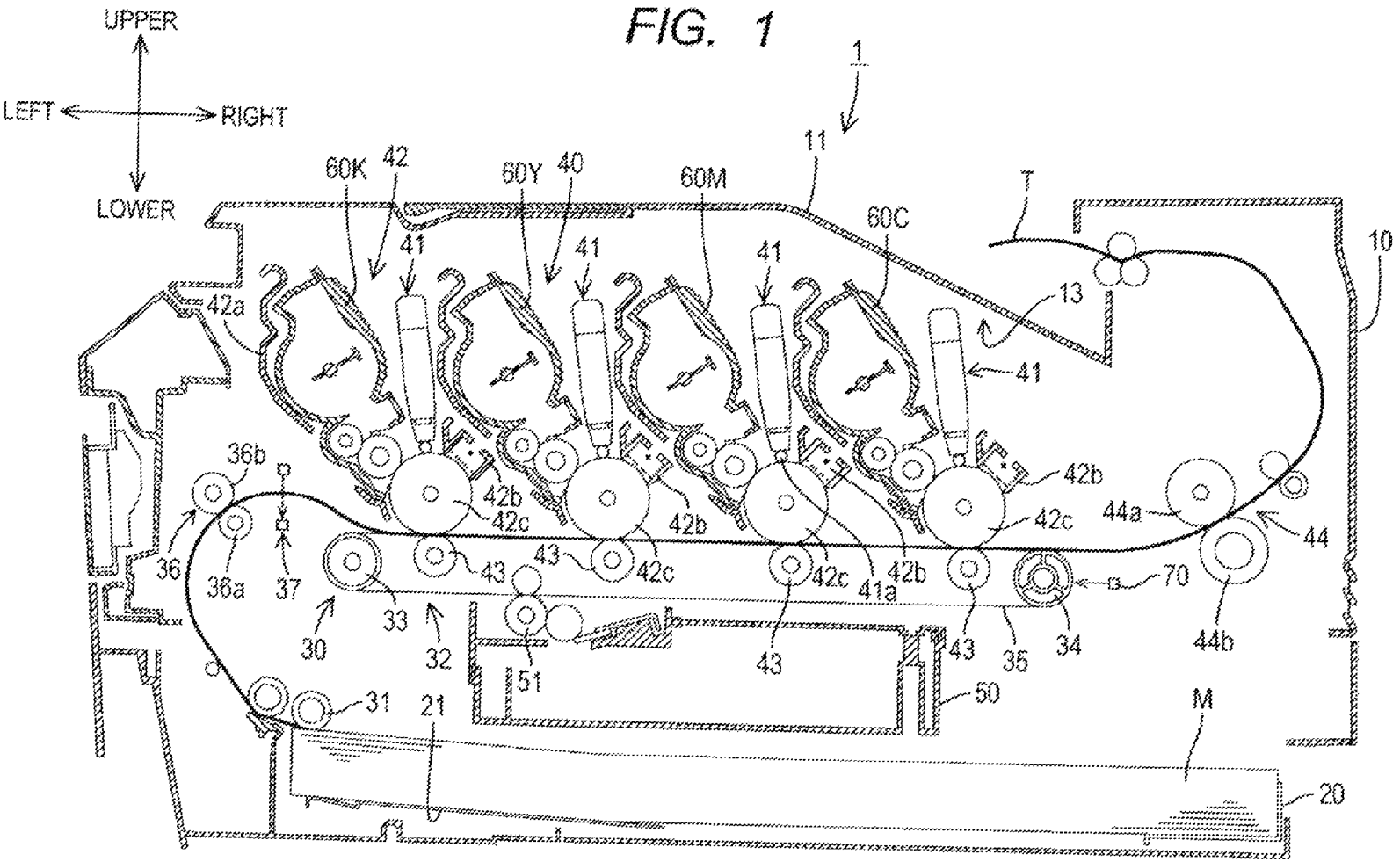
FIG. 1 is a cross-sectional view showing the configuration of a printer according to a first embodiment in a simplified manner.

First, the configuration of a printer 1 serving as the printing apparatus according to the first embodiment will be described while referring to FIG. 1. The printer 1 is a color laser printer of a direct-transfer tandem type that prints a color image on a sheet, such as printing paper, with toner in four colors is C (cyan), M (magenta), Y (yellow), and K (black).

The printer 1 includes a main casing 10, a paper accommodating section 20, a conveying section (conveying device) 30, a printing section (printing device) 40, a cleaning unit 50, optical sensors 70, and the like.

The main casing 10 is formed in substantially a box shape having an opening 13 opened upward. An open/close cover 11 for opening/closing the opening 13 is coupled to the main casing 10.

The paper accommodating section 20 has a paper tray 21 in which sheets M are stacked. The paper tray 21 is urged upward by a spring (not shown), and the sheet M stacked at the uppermost position is the paper tray 21 is in pressure contact with a pickup roller 31.

The conveying section 30 includes the pickup roller 31, registration rollers 36, a belt unit 32, a post-registration sensor 37, and other conveying rollers. The conveying section 30 conveys sheets M accommodated in the paper accommodating section 20 one sheet at a time along a conveying path T.

The registration rollers 36 consist of a drive roller 36*a* and a follow roller 36*b*. The sheet M is sent to the conveying path T by the pickup roller 31 in a state where rotation of the registration rollers 36 is stopped, and its leading end makes contact with the registration rollers 36. In this state, the pickup roller 31 sends the sheet M farther, so that inclination of the sheet M (so called skewing) is corrected. Subsequently, the registration rollers 36 rotate to send the sheet M in a state where skewing is corrected. The registration rollers 36 are an example of a skew correction roller.

However, as the printer 1 is used, due to wear of the registration rollers 36 or the like, it can happen that the sheet M is sent from the registration rollers 36 in a state skewing is not corrected sufficiently.

The belt unit 32 includes a drive roller 33, a follow roller 34, an endless conveying belt 35 looped around the rollers 33 and 34, a drive motor (not shown) that rotatingly drives the drive roller 33, and the like. The direction in which the conveying belt 35 conveys the sheet M, that is, a conveying direction is from the left to the right in FIG. 1. In the following descriptions, the conveying direction of the sheet M is referred to as a sub-scanning direction. Further, the direction perpendicular to the surface of the drawing sheet of FIG. 1 is a roam scanning direction which is perpendicular to the conveying direction.

The post-registration sensor 37 is disposed between the registration rollers 36 and the conveying belt 35. The post-registration sensor 37 outputs an ON signal to a controller 80 when the sheet M is located within a detection range, and outputs an OFF signal when the sheet M is not located within the detection range. For example, a sensor having a light emitting portion and a light receiving portion can be used as the post-registration sensor 37.

The printing section 40 includes a plurality of exposing sections 41, a plurality of process cartridges 42, a plurality of transfer rollers 43, and a fixing unit 44. The printing section 40 prints an image on the sheet M that is conveyed by the conveying section 30. In addition, the printing section 40 prints an image such as a skew detection mark 90 described later on the outer peripheral surface of the conveying belt 35.

Each exposing section 41 has an LED head in which a plurality of LEDs are linearly arranged in the main scanning direction. In the exposing section 41, the LEDs emit light in accordance with image signals outputted from the controller 80 (see FIG. 2) so as to expose the outer peripheral surface of a photosensitive drum 42*c* to light.

Note that the exposing section 41 may be constituted by a light source, a polygon mirror that deflects light emitted from the light source, an optical system that images light deflected by the polygon mirror at the surface of the photosensitive drum 42*c*, and the like.

The process cartridge 42 includes a cartridge frame 42*a*, a charger 42*b*, and the photosensitive drum 42*c*.

The cartridge frame 42*a* is detachably mounted on the printer 1. Toner cartridges 60 (60C, 60M, 60Y, and 60K) in four colors in C (cyan), M (magenta), Y (yellow), and K (black) are detachably mounted on the cartridge frame 42*a*.

The charger 42*b* is a Scorotron charger, for example, and uniformly positively charges the outer peripheral surface of the photosensitive drum 42*c*. After the outer peripheral surface of the photosensitive drum 42*c* is charged by the charger 42*b*, the outer peripheral surface of the photosensitive drum 42*c* is exposed by light emitted from the exposing section 41, so that an electrostatic latent image is formed on the outer peripheral surface of the photosensitive drum 42*c*. The electrostatic latent image formed on the outer peripheral surface of the photosensitive drum 42*c* is developed by toner supplied from the toner cartridge 60, and a toner image is borne on the surface of the photosensitive drum 42*c*.

The plurality of transfer rollers 43 is provided at positions opposing the respective photosensitive drums 42*c* with the conveying belt 35 interposed therebetween. While the sheet M conveyed by the belt unit 32 passes through each transfer position between the photosensitive drum 42*c* and the transfer roller 43, the toner image borne on the surface of each photosensitive drum 42*c* is sequentially transferred onto the sheet M due to a negative transfer bias applied to the transfer roller 43.

Here, the exposing section 41, the charger 42*b*, the photosensitive drum 42*c*, and the transfer roller 43 corresponding to one color constitute one processing section. That is, the printing section 40 includes four processing sections corresponding to four colors of CMYK.

The fixing unit 44 includes a heat roller 44*a* within which a heat source such as a halogen lamp is accommodated, and a follow roller 44*b* that rotates in pressure contact with the heat roller 44*a*, thereby thermally fixing, on the sheet M, the toner image transferred onto the sheet M.

The sheet M on which the toner image is thermally fixed is discharged onto a paper discharge tray which is constituted by the open/close cover 11.

The cleaning unit 50 is disposed below the belt unit 32. The cleaning unit 50 has a plurality of rollers including a cleaning roller 51 in contact with the conveying belt 35 for recovering toner and paper powders remaining on the conveying belt 35.

Figure 2:
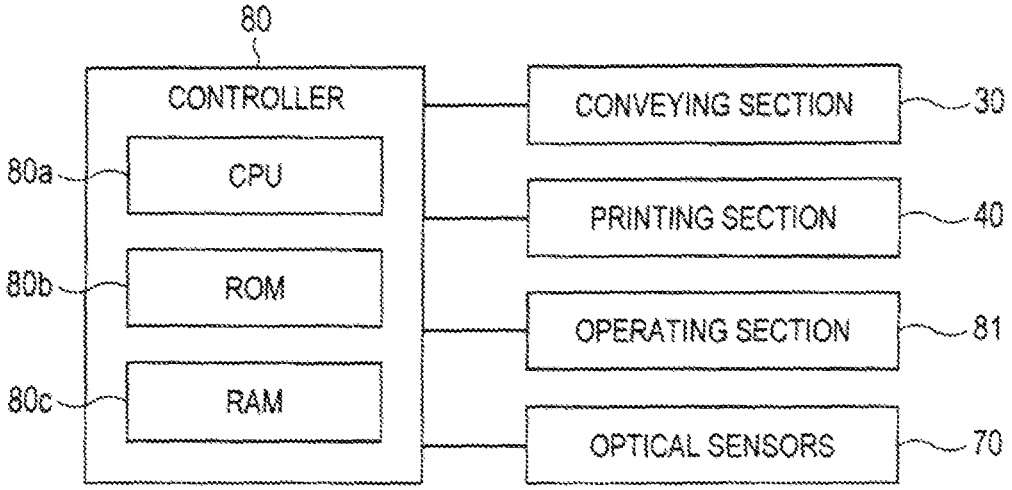
FIG. 2 is a block diagram showing the electrical configuration of the printer in a simplified manner.
Figure 3:
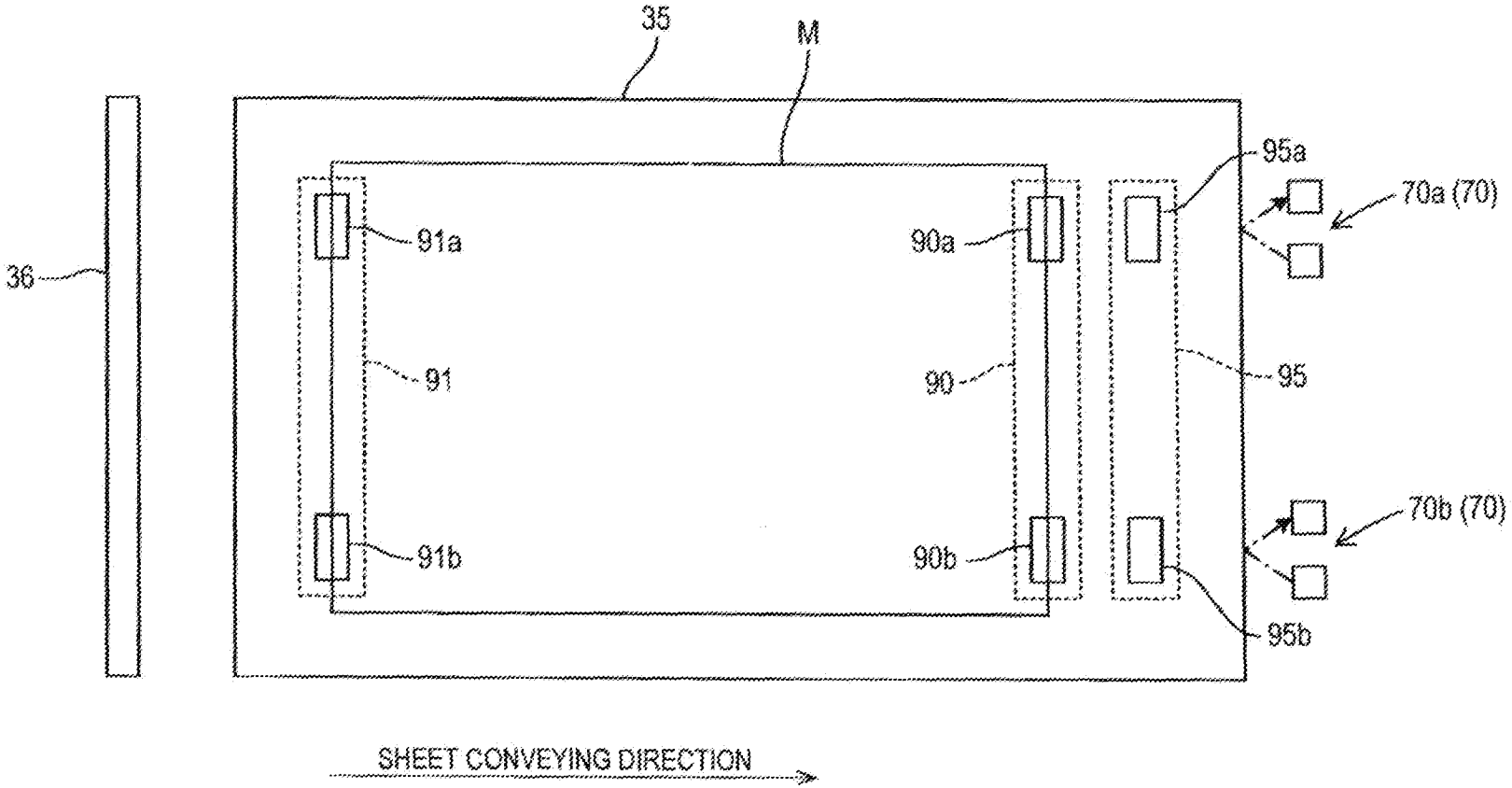
FIG. 3 is a schematic view showing a skew detection mark and a correction-information acquisition mark.

The two optical sensors 70 are arranged to be spaced away from each other in the main scanning direction (see FIG. 3). The optical sensors 70 emit light to different detection regions on the outer peripheral surface of the conveying belt 35, receive light reflected by the conveying belt 35, and output, to the controller 80 (see FIG. 2), detection signals in accordance with luminance of the received light. The optical sensors 70 are an example of a sensor.

(2) Electrical Configuration of Printer

Next, the electrical configuration of the printer 1 will be described while referring to FIG. 2. The printer 1 includes the controller 80, the conveying section 30, the printing section 40, an operating section 81, the optical sensors 70, and the like.

The controller 80 includes a CPU 80*a*, a ROM 80*b*, and a RAM 80*c*. The CPU 80*a* executes various programs stored in the ROM 80*b*, thereby controlling each section of the printer 1. The ROM 80*b* stores control programs executed by the CPU 80*a*, various data, and the like. The RAM 80*c* is used as a main memory for the CPU 80*a* to execute various processes.

The operating section 81 includes a liquid crystal display, buttons, and the like. The user can perform various settings and the like, by operating the operating section 81.

(3) Print Controlling Process Executed by Controller

Next, a print controlling process executed by the controller 80 will be described. The print controlling process is a process for printing an image specified by the user on the sheet M.

In the print controlling process, the controller 80 executes a process for detecting skew of the sheet M that is conveyed by the conveying belt 35, a process for detecting rotational movement of the sheet M while being conveyed by the conveying belt 35, a process for detecting misregistration of an image in the sub-scanning direction relative to the sheet M, a process for acquiring correction information of the optical sensors 70, and an out-of-color-registration correcting process for correcting an out-of-color-registration state which occurs due to relative misregistration of images in each color.

Hereinafter, each process described above will be described individually and, after that, the flowchart of the print controlling process will be described.

(3-1) Process for Detecting Skew of Sheet

The process for detecting skew of the sheet M that is conveyed by the conveying belt 35 will be described while referring to FIGS. 3 through 5. The controller 80 prints a skew detection mark 90 shown in FIG. 3 so that the skew detection mark 90 extends over an end of the sheet M and the outer peripheral surface of the conveying belt 35, and detects skew (inclination) of the sheet M using the printed skew detection mark 90. Here, the skew detection mark 90 will be described first, and then detection of skew of the sheet will be described.

(3-1-1) Skew Detection Mark

As shown in FIG. 3, the controller 80 in the first embodiment prints the skew detection mark 90 so that the skew detection mark 90 extends (ranges) over the leading end of the sheet M and the outer peripheral surface of the conveying belt 35. The skew detection mark 90 includes two partial skew detection marks 90*a* and 90*b* that are printed at positions spaced away from each other in the main scanning direction. The two partial skew detection marks 90*a* and 90*b* are printed at positions passing detection regions on the conveying belt 35 that are detected by the optical sensors 70, the detection regions being regions detected by the optical sensors 70 different from each other. More specifically, the partial skew detection mark 90*a* is printed at a position that is detected by an optical sensor 70*a*, and the partial skew detection mark 90*b* is printed at a position that is detected by an optical sensor 70*b*.

Here, the skew detection mark 90 (the both partial skew detection marks 90*a* and 90*b*) is printed in black. The reason why the skew detection mark 90 is printed in black will be described later.

(3-1-2) Detection of Skew of the Sheet

Figure 4:
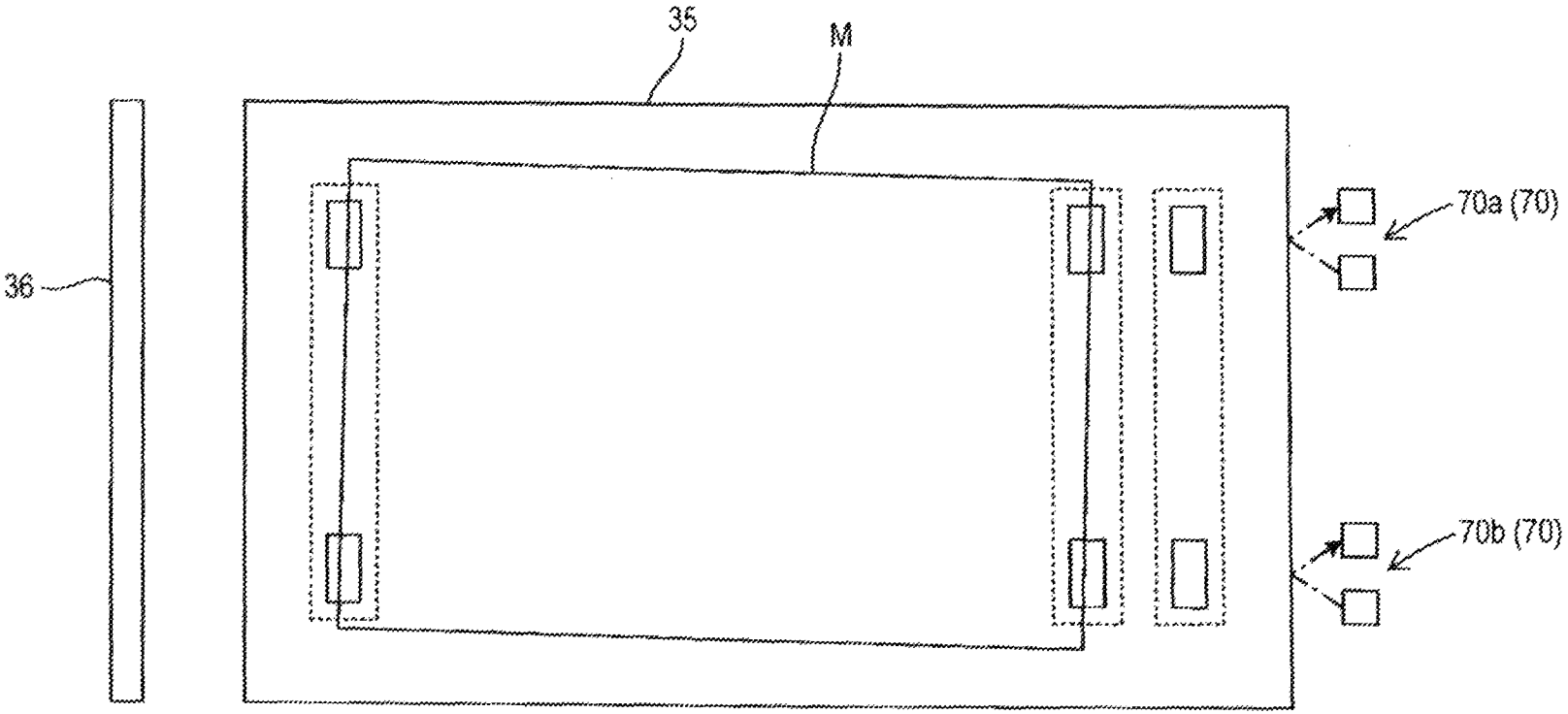
FIG. 4 is a schematic view showing a skewed sheet.
Figure 5:
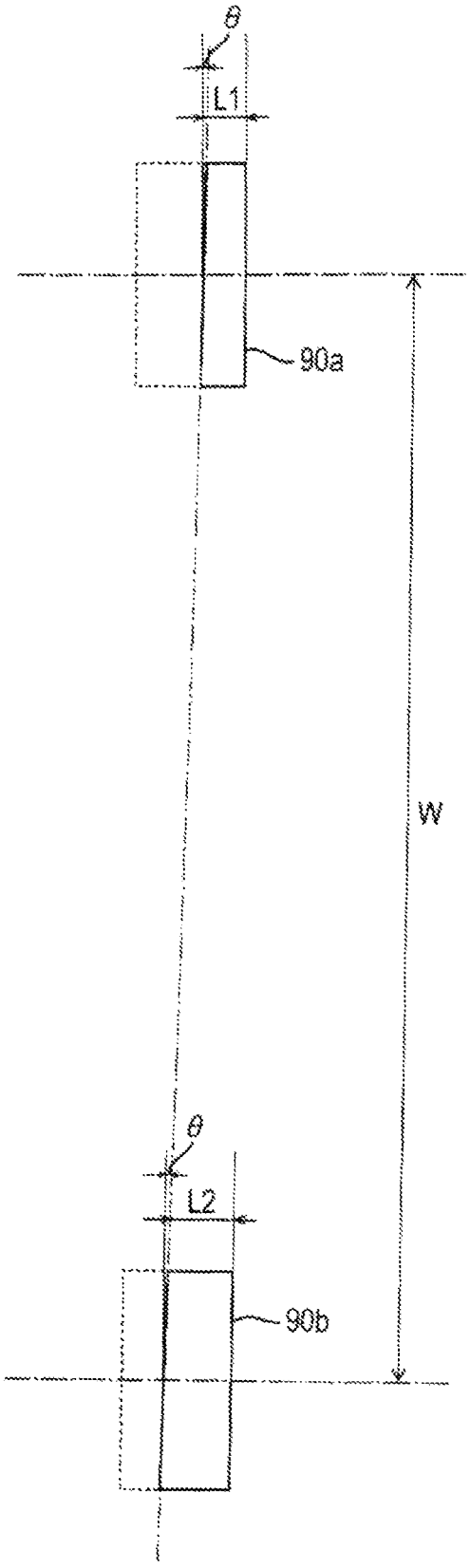
FIG. 5 is a schematic view showing the skew detection mark that is left on a convening belt in a case where the sheet is skewed.

As shown in FIG. 4, assume that the sheet M is skewed (inclined). Here, a portion of the skew detection mark 90 left on the conveying belt 35 has a shape shown in FIG. 5. In this case, a skew angle θ of the sheet M can be obtained with equation 1 shown below.

$$\tan\theta=(L1-L2)/W \qquad \text{Equation 1}$$

Here, L1 is a width of the partial skew detection mark 90*a* in the sub-scanning direction that is detected by the optical sensor 70*a*. L2 is a width of the partial skew detection mark 90*b* in the sub-scanning direction that is detected by the optical sensor 70*b*. W is a distance between a center of the partial skew detection mark 90*a* in the main scanning direction and a center of the partial skew detection mark 90*b* in the main scanning direction. W is preliminarily stored in the ROM 80*b*.

If the sheet M is skewed (inclined), for a subsequent sheet M that is led after the sheet M used for detection of skew, the controller 80 performs correction of relative skew between the subsequent sheet M and an image to be printed on the subsequent sheet M. This correction can be performed in various ways.

For example, relative skew may be corrected by correcting skew (inclination) of the sheet M. Specifically, the main reason why the sheet M is skewed is that, due to shortness of a time period during which the registration rollers 36 are stopped, the sheet M is sent onto the conveying belt 35 before skewing of the sheet M is corrected completely. Hence, if the sheet M is skewed, skew of the sheet M may be corrected more reliably by increasing a time period during which the registration rollers 36 are stopped.

Alternatively, for example, relative skew between the sheet M and the image may be corrected by printing while the image is inclined based on the detected skew angle θ, without performing correction of skew of the sheet M. Note that the method of correcting relative skew between the sheet M and the image to be printed on the sheet M is not limited to ones described above, and may be performed in an appropriate method.

Note that skew of the sheet may be detected using a second skew detection mark 91 described later.

(3-2) Detection of Rotational Movement of the Sheet while being Conveyed by the Conveying Belt Next, the process for detecting rotational movement of the sheet while being conveyed by the conveying belt 35 will be described while referring to FIGS. 3 and 6.

As shown in FIG. 3, the controller 80 in the first embodiment prints two skew detection marks on a single sheet M. That is, the controller 80 prints the above-described skew detection mark 90 (referred to as "first skew detection mark 90") so that the skew detection mark 90 extends over the leading end of the sheet M and the outer peripheral surface of the conveying belt 35, and also prints the second skew detection mark 91 so that the skew detection mark 91 extends over the trailing end of the sheet M and the outer peripheral surface of the conveying belt 35.

The shape of the second skew detection mark 91 is the same as the shape of the first skew detection mark 90. The second skew detection mark 91 is also printed in black.

Figure 6:
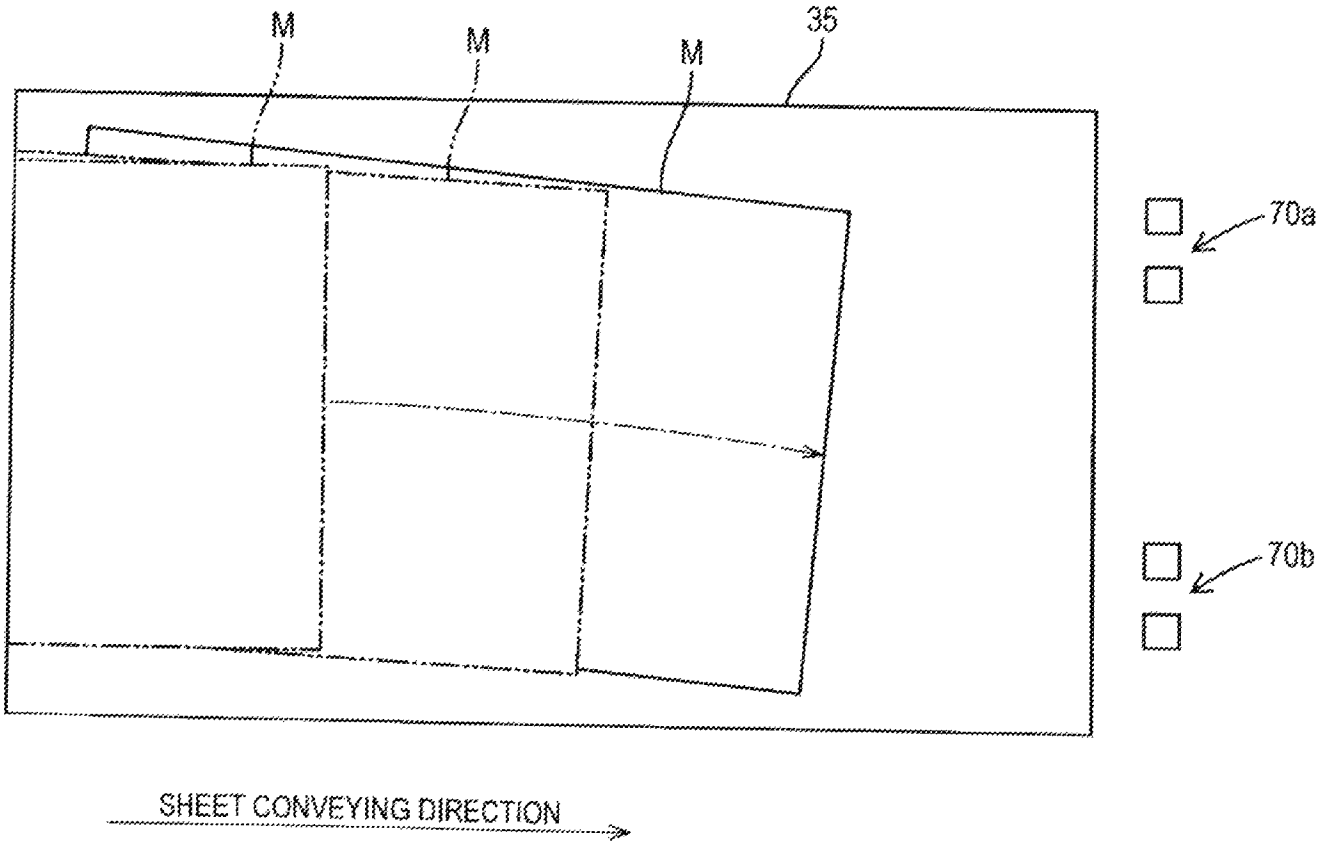
FIG. 6 is a schematic view showing rotational movement of title sheet.

As shown in FIG. 6, there is a case in which the sheet M is rotationally moved while the sheet M is conveyed by the conveying belt 35. In a case where the sheet M is rotationally moved, the rotational angle can be calculated as a difference between a skew angle of the sheet M that is detected from the first skew detection mark 90 and a skew angle of the sheet M that is detected from the second skew detection mark 91.

Assuming that, when the sheet M rotationally moves, a sheet M subsequent to the current sheet M rotationally moves similarly, the controller 80 prints an image on the subsequent sheet M while changing the angle of the image relative to the subsequent sheet M, for example, each line. Here, one line refers to a line extending in the main scanning direction. The angle to be inclined per line can be obtained by dividing the above-described rotational angle by the number of lines per sheet for example.

(3-3) Detection of Misregistration of the Image in the Sub-Scanning Direction Relative to the Sheet When there is no misregistration of an image in the sub-scanning direction relative to the sheet M, a width of a portion of the first skew detection mark 90 in the sub-scanning direction that is left on the conveying belt 35 matches a reference width that is preliminarily stored in the ROM 80*b*. Thus, the controller 80 detects, with the optical sensors 70, the width of the portion of the first skew detection mark 90 in the sub-scanning direction that is left on the conveying belt 35, and compares the detected width with the above-mentioned reference width, thereby determining the amount of misregistration of the image in the sub-scanning direction relative to the sheet M.

First, descriptions will be provided for a case in which the sheet M is not skewed. For example, assume that the optical sensors 70 have detected that widths of portions of the partial skew detection marks 90*a* and 90*b* of the first skew detection mark 90 in the sub-scanning direction that are left on the conveying belt 35 are both 5 mm (millimeters). The reference width is 6 mm. In this case, the controller 80 determines that the amount of misregistration of the image in the sub-scanning direction relative to the sheet M is +1 mm (=6−5) in the upstream side in the sub-scanning direction.

In this case, the controller 80 advances timing, in the sub-scanning direction, at which the exposing section 41 starts exposure by a time period corresponding to 1 mm, using timing at which the leading end is detected by the post-registration sensor 37 as the reference. With this operation, misregistration of the image in the sub-scanning direction relative to the sheet M is corrected.

Next, descriptions will be provided for a case in which the sheet M is skewed. For example, when the amount of misregistration detected from the partial skew detection mark 90*a* of the first skew detection mark 90 is −1 mm, and the amount of misregistration detected from the partial skew detection mark 90*b* is −1 mm, the average of these amounts of misregistration is 0 mm. When the averaged amount is 0 mm, misregistration of the image in the sub-scanning direction relative to the sheet M is eliminated by correcting skew of the sheet M. Hence, the amount of misregistration of the image in the sub-scanning direction relative to the sheet M may be regarded as 0 mm.

On the other hand, for example, when the amount of misregistration detected from the partial skew detection mark 90*a* is −1 mm, and the amount of misregistration detected from the partial skew detection mark 90*b* is −3 mm, the average of these amounts of misregistration is −2 mm. When the averaged amount is −2 mm, the controller 80 corrects skew of the sheet M and, in addition, the controller 80 delays timing, in the sub-scanning direction, at which the exposing section 41 starts exposure by a time period corresponding to 2 mm.

Note that relationships among the amount of misregistration detected from the partial skew detection mark 90*a*, the amount of misregistration detected from the partial skew detection mark 90*b*, and the amount of misregistration of the image in the sub-scanning direction relative to the sheet M after skew of the sheet M is corrected may be preliminarily obtained based on experiments or the like, and the amount of misregistration of the image in the sub-scanning direction relative to the sheet M may be determined by referring to the relationships.

Further, the amount of misregistration of an image in the sub-scanning direction relative to the sheet may be detected using the above-described second skew detection mark 91.

(3-4) Acquisition of Correction Information of Optical Sensors Using Correction-Information Acquisition Mark Next, acquisition of correction information of the optical sensors 70 using a correction-information acquisition mark 95 will be described while referring to FIG. 3.

For example, the width of the skew detection mark 90 in the sub-scanning direction is detected by the optical sensor 70. At this time, although the width of the skew detection mark 90 in the sub-scanning direction is 6 mm, there is a possibility that the optical sensor 70 outputs a detection signal corresponding to 5 mm because of variability of detection accuracy due to individual difference of the optical sensor 70, misalignment of a distance between the optical sensor 70 and the conveying belt 35, or the like.

Hence, as shown in FIG. 3, the controller 80 prints the correction-information acquisition mark 95 on the outer peripheral surface of the conveying belt 35 prior to printing the first skew detection mark 90. The correction-information acquisition mark 95 in the first embodiment has the same shape as the shape of the skew detection marks 90 and 91. Further, in the first embodiment, the correction-information acquisition mark 95 is also printed in black.

And, the controller 80 detects the width of the correction-information acquisition mark 95 in the sub-scanning direction using the optical sensors 70, and acquires, as correction information, a difference between the detected width and the width of the correction-information acquisition mark 95 in the sub-scanning direction to be detected ideally. The width of the corrosion-information acquisition mark 95 in the sub-scanning direction to be detected ideally is preliminarily stored in the ROM 80*b*.

And, the controller 80 corrects the detection signal outputted from the optical sensors 70 based on the correction information. For example, the following example will be considered.

(a) The width of the correction-information acquisition mark 95 in the sub-scanning direction that is detected by the optical sensor 70=9 mm (b) The width of the correction-information acquisition mark 95 in the sub-scanning direction that is to be detected ideally=10 mm (c) The width, detected by the optical sensor 70, of the portion of the skew detection mark 90 in the sub-scanning direction that is left on the conveying belt 35=5 mm In the case of the above-described example, the correction information is 1 mm (=10−9). If the correction information is a positive (+) value, the detected width is smaller than the width to be detected ideally. Thus, the controller 80 adds 1 mm to 5 mm which is the width, detected by the optical sensor 70, of the portion of the skew detection mark 90 in the sub-scanning direction that is left on the conveying belt 35. Accordingly, the width of the portion of the skew detection mark 90 in the sub-scanning direction that is left on the conveying belt 35 is corrected to be 6 mm.

Alternatively, correction may be performed by multiplying the detected width 5 mm by a value of 10/9. However, depending on the type of the optical sensor 70, even when the width of the portion of the skew detection mark 90 that is left on the conveying belt 35 differs, the error is substantially constant. The optical sensor 70 used in the first embodiment is such a sensor that the error is substantially constant, and the same value is added as correction information (correction value) regardless of the detected width.

Note that, although in FIG. 3 the correction-information acquisition mark 95 is printed prior to the first skew detection mark 90, the correction-information acquisition mark 95 may be printed subsequent to the second skew detection mark 91.

(3-5) Out-of-Color Registration Correcting Process

Next, the out-of-color-registration correcting process will be described while referring to FIG. 7. When relative positions of images in each color are misaligned, so-called a state of out-of-color-registration occurs. Hence, the controller 80 executes the out-of-color-registration correcting process for suppressing the state of out-of-color-registration every time a certain number of sheets are printed.

Figure 7:
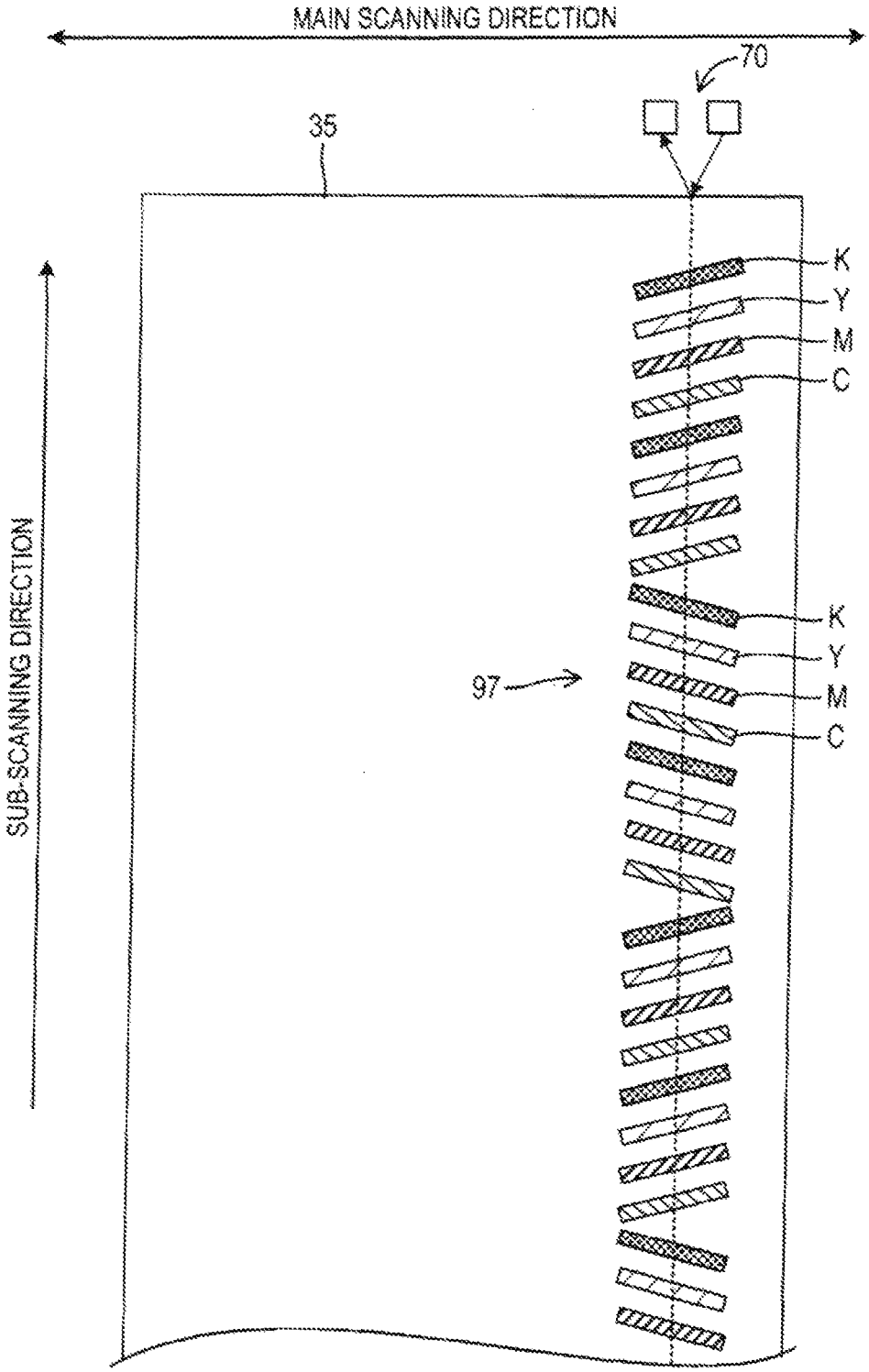
FIG. 7 is a schematic view showing the conveying belt on which misregistration correction marks are directly printed.

In the out-of-color-registration correcting process, as shown in FIG. 7, the controller 80 controls the printing section 40 to directly print misregistration correction marks 97 for each color on the outer peripheral surface of the conveying belt 35. Each of the misregistration correction marks 97 is inclined relative to the main scanning direction. The process of printing the misregistration correction marks 97 is an example of a misregistration-correction-mark printing process.

The controller 80 controls the conveying section 30 to drive the conveying belt 35 to rotatingly move and, in this state, determines a position of each misregistration correction mark 97 based on detection signals outputted from the optical sensor 70.

Then, based on the position of each misregistration correction mark 97, the controller 80 detects the amount of misregistration, in the main scanning direction and in the sub-scanning direction, of the misregistration correction mark 97 in another color (non-reference color) relative to the misregistration correction mark 97 in the color that is selected as the reference color. Although the reference color can be selected appropriately, the reference color is black in this embodiment. The process of detecting the amount of misregistration. In the main scanning direction and in the sub-scanning direction, of the misregistration correction mark 97 in another color (non-reference color) is an example of a misregistration-amount detection process.

Here, the reason why each of the misregistration correction marks 97 is inclined relative to the main scanning direction is to detect misregistration in the main scanning direction. Misregistration can be obtained from each timing at which two misregistration correction marks 97 having the same color and inclined toward the opposite sides pass the optical sensor 70. For example, in FIG. 7, if a time period from when the first diagonally-right-up K (black) misregistration correction mark 97 passes the optical sensor 70 until when the next diagonally-right-down K (black) misregistration correction mark 97 passes the optical sensor 70 is larger than a reference period, it can be determined that K (black) images are shifted to the left. Further, the amount of the shift (misregistration) can also be obtained.

And, the controller 80 adjusts horizontal synchronization timing and vertical synchronization timing of the processing section of another color, using timing in the main scanning direction at which the processing section of the reference color starts exposure (hereinafter, referred to as "horizontal synchronization timing") and timing in the sub-scanning direction at which the processing section of the reference color starts exposure (hereinafter, referred to as "vertical synchronization timing"), for example, thereby adjusting a print position of an image in another color so as to be aligned with a position at which an image in the reference color is printed. With this adjustment, relative misregistration among images in each color is corrected. The process of correcting relative misregistration among images in each color is an example of a misregistration correction process.

(3-6) Reason why the Skew Detection Mark is Printed in Black

As described above, in the first embodiment, the first skew detection mark 90 is printed in black. The reason why the skew detection mark 90 is printed in black will be described below.

The first reason is to accurately determine whether skew of the sheet M is caused by the registration rollers 36. As described above, there is a case in which the sheet M rotationally moves while being conveyed by the conveying belt 35. The rotational angle becomes larger as a distance becomes longer in which the sheet M is conveyed by the conveying belt 35. Hence, if the skew detection mark 90 is printed by a processing section that is far from the registration rollers 36, when the sheet M is skewed, it is impossible to determine whether the skew is caused by insufficient skew correction by the registration rollers 36 or the skew is caused by rotational movement while being conveyed by the conveying belt 35.

In contrast, if the skew detection mark 90 is printed by a processing section that is closest to the registration rollers 36, the skew detection mark 90 is printed in a state where there is little rotational movement of the sheet M due to the conveying belt 35. Thus, when the sheet M is skewed, it is possible to determine that the skewing is caused by insufficient skew correction by the registration rollers 36. In the first embodiment, the processing section closest to the registration rollers 36 is the processing section for black. Hence, the controller 80 prints the skew detection mark 90 in black.

The second reason is because the color used as the reference color in the above-described out-of-color-registration correcting process is black. As described above, the skew detection mark 90 can also be used for detecting misregistration of an image in the sub-scanning direction relative to the sheet M. Assume that the skew detection mark 90 is printed in a color different from the reference color. In this case, even though misregistration of the image in the sub-scanning direction relative to the sheet M is corrected using the skew detection mark 90, the out-of-color-registration correcting process is executed using the reference color, and the position of the image in the sub-scanning direction relative to the sheet M could be misaligned again.

For example, assume that the skew detection mark 90 is printed in a color other than the reference color, that misregistration of the image in the sub-scanning direction relative to the sheet M is corrected, and that subsequently the out-of-color-registration correcting process is executed. In this case, because the position of the image in the color used for printing the skew detection mark 90 is corrected with respect to the reference color, the position of the image in the sub-scanning direction relative to the sheet M is misaligned (shifted).

In contrast, because the skew detection mark 90 is printed in the reference color in this embodiment, the position of the image in the reference color in the sub-scanning direction relative to the sheet M does not move even if the out-of-color-registration correcting process is executed. This prevents a shift (misalignment) of the position of the image in the sub-scanning direction relative to the sheet M.

Further, for example, assume that the out-of-color-registration correcting process is executed, and that subsequently the skew detection mark 90 is printed in a color other than the reference color to correct misregistration of an image in the sub-scanning direction relative to the sheet M. In this case, the position, in the sub-scanning direction, of the image in the color used for printing the skew detection mark 90 relative to the sheet M is corrected, and a print position of the image in the color used for printing the skew detection mark 90 relative to the image in the reference color is shifted (misaligned). This causes a state of out-of-color-registration.

In contrast, because the skew detection mark 90 is printed in the reference color in this embodiment, misregistration of the image in the sub-scanning direction relative to the sheet M is corrected and, even if the position of the image in the reference color is corrected because of this, print positions of images in other colors are corrected so as to be aligned with the print position of the image in the reference color. Thus, a state of out-of-color-registration is not caused.

(3-7) Print Controlling Process

Figure 8:
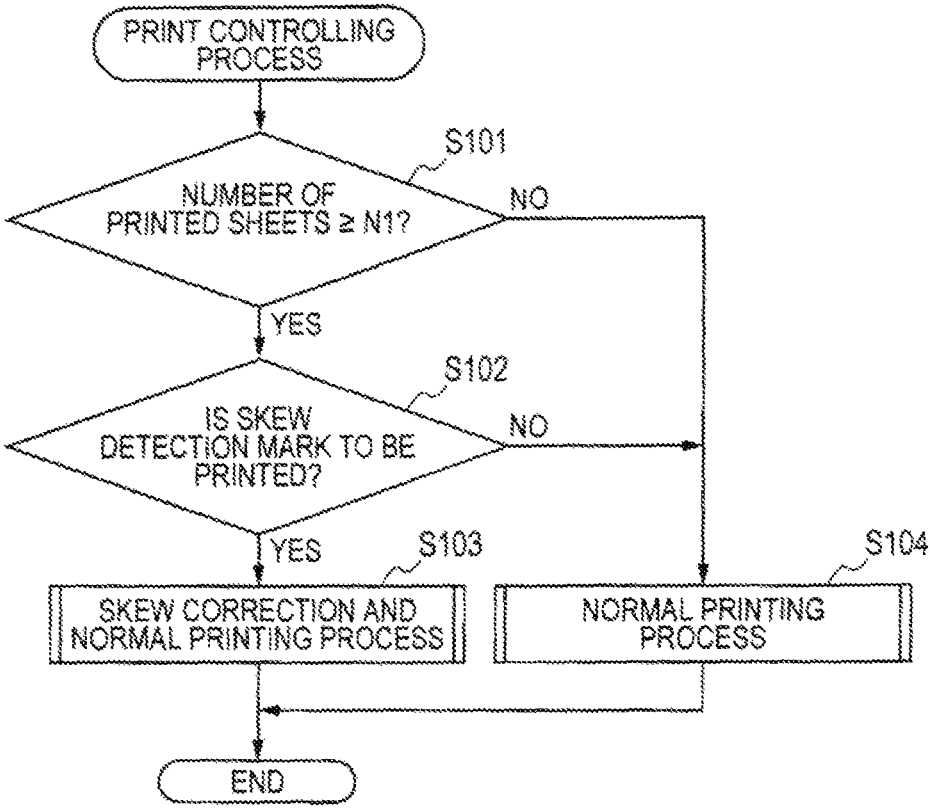
FIG. 8 is a flowchart showing the flow of a print controlling process.

Next, the print controlling process executed by the controller 80 will be described while referring to the flowchart in FIG. 8. This process is started when a user gives an instruction to print an image.

Here, if the number of sheets printed subsequent to previous detection of skewing of the sheet M is greater than or equal to a reference number N1, the skew detection mark 90 and the correction-information acquisition mark 95 are printed. If the number of sheets printed subsequent to previous detection of skew of the sheet M is less than the reference number N1, the skew detection mark 90 and the correction-information acquisition mark 95 are not printed. This is because, if the number of printed sheets is less than the reference number N1, it is expected that skewing of the sheet M or the like is not changed greatly. Note that the reference number N1 can be determined appropriately based on experiments or the like.

Here, an example will be described in which the skew detection mark 90 is printed on the same sheet M as the sheet M on which an image for which the user gives a print instruction is printed. The reason why the skew detection mark 90 is printed on the same sheet M is that an additional sheet M is required if the skew detection mark 90 is printed on a sheet M different from the sheet M on which an image for which the user gives a print instruction is printed. Thus, by printing the skew detection mark 90 on the same sheet M, the sheet M can be saved.

However, a user sometimes does not wish the skew detection mark 90 to be printed on the sheet M on which an image for which the user gives a print instruction is printed. Hence, when the user gives a print instruction, he/she can set whether to print the skew detection mark 90. Setting of print conditions may be performed on a personal computer (abbreviated as "PC") that is connected with the printer 1 for communication, or may be performed through the operating section 81 of the printer 1.

If the setting is such that the skew detection mark 90 is not to be printed, the controller 80 does not print the skew detection mark 90. Accordingly, if the setting is such that the skew detection mark 90 is not to be printed, detection of skew of the sheet M and the like are not executed.

Here, assume that an instruction to print a plurality of images is given. The plurality of images is printed on separate sheets M, respectively.

In S101, the controller 80 determines whether the number of sheets printed subsequent to previous detection of skew of the sheet M is greater than or equal to the reference number N1, and proceeds to S102 if the number of printed sheets is greater than or equal to the reference number N1 (S101: Yes), or proceeds to S104 if the number of printed sheets is less than the reference number N1 (S101: No).

In S102, the controller 80 determines whether the setting is such that the skew detection mark 90 is to be printed, and proceeds to S103 if the setting is such that the skew detection mark 90 is to be printed (S102: Yes), or proceeds to S104 if the setting is such that the skew detection mark 90 is not to be printed (S102: No).

In S103, the controller 80 executes a skew correction and normal printing process. In S104, the controller 80 executes a normal printing process.

(3-7-1) Skew Correction and Normal Printing Process

Next, the skew correction and normal printing process executed in the above-described S103 will be described while referring to FIG. 9.

In S201, the controller 80 determines whether the number of sheets printed subsequent to previous execution of the out-of-color-registration correcting process is greater than or equal to a predetermined reference number N2. If the number of printed sheets is greater than or equal to the reference number N2 (S201: Yes), the process proceeds to S202 based on a presumption that the amount of out-of-color-registration reaches a reference amount. If the number of printed sheets is less than the reference number N2 (S201: No), the process proceeds to S203 based on a presumption that the amount of out-of-color-registration has not reached the reference amount.

In S202, the controller 80 executes the above-described out-of-color-registration correcting process.

In S203, the controller 80 controls the conveying section 30 to start conveying of the sheet M.

In S204, the controller 80 waits until the leading end of the sheet M passes the post-registration sensor 37. After the leading end of the sheet M passes the post-registration sensor 37, the process proceeds to S205.

In S205, the controller M controls the printing section 40 to print the correction-information acquisition mark 95 on the conveying belt 35. Step S205 is an example of a correction-information-acquisition-mark printing process.

In S206, the controller 80 controls the printing section 40 to print the first skew detection mark 90 to extend over a leading end portion of the sheet M and the outer peripheral surface of the conveying belt 35. Step S206 is an example of a skew-detection-mark printing process.

In S207, the controller 80 controls the printing section 40 to print, on the sheet M, the first one of images specified by the user.

In S208, the controller 80 detects, with the optical sensors 70, the correction-information acquisition mark 95 and the first skew detection mark 90 that are left on the conveying belt 35.

In S209, the controller 80 waits until the trailing end of the sheet M passes the post-registration sensor 37. After the trailing end of the sheet M passes the post-registration sensor 37, the process proceeds to S210.

In S210, the controller 80 controls the printing section 40 to print the the second skew detection mark 91 to extend over a trailing end portion of the sheet M and the outer peripheral surface of the conveying belt 35. Step S206 is an example of a skew-detection-mark printing process. Step S210 is an example of the skew-detection-mark printing process.

In S211, the controller 80 detects, with the optical sensors 70, the second skew detection mark 91 that is left on the conveying belt 35.

In S212, the controller 80 detects the correction-information acquisition mark 95 with the optical sensors 70 and, based on outputted detection signals, calculates each of a width of a partial correction-information acquisition mark 95*a* in the sub-scanning direction and a width of a partial correction-information acquisition mark 95*b* in the sub-scanning direction, and acquires correction information for each of the optical sensors 70.

In S213, the controller 80 calculates each width of the partial skew detection marks 90*a* and 90*b* of the first skew detection mark 90 in the sub-scanning direction based on detection signals outputted from the optical sensors 70, and corrects the calculated widths using correction information. Specifically, the controller 80 corrects the width of the partial skew detection mark 90*a* using correction information of the optical sensor 70*a*, and corrects the width of the partial skew detection mark 90*b* using correction information of the optical sensor 70*b*.

In S214, the controller 80 calculates each width of partial skew detection marks 91*a* and 91*b* of the second skew detection mark 91 in the sub-scanning direction based on detection signals outputted from the optical sensors 70, and corrects the calculated widths using correction information, like S213.

In S215, the controller 80 executes an exposure timing, skew, and rotational movement correcting process. The exposure timing, skew, and rotational movement correcting process is a process of correcting timing in the sub-scanning direction at which the exposing section 41 starts exposure, relative skew between the sheet M and an image, and relative skew between the sheet M and the image due to rotational movement of the sheet M while being conveyed by the conveying belt 35. The exposure timing, skew, and rotational movement correcting process will be described later in greater detail.

In S216, the controller 80 determines whether the next image exists. If the next image exists, the process proceeds to S217. If the next image does not exist, the process ends and returns to the print controlling process.

In S217, the controller 80 controls the printing section 40 to print the next image on the sheet M.

In printing of the next image and thereafter, because the exposure timing, skew, and rotational movement correcting process is executed in S215, skew of the sheet M is corrected at a time point when the sheet M is fed from the registration rollers 36. Because timing in the sub-scanning direction at which exposure is started is corrected, printing is performed without misregistration of an image in the sub-scanning direction relative to the sheet M. In addition, because, even if the sheet M is rotationally moved while being conveyed by the conveying belt 35, an image is printed while being inclined for each line with an angle set in the exposure timing, skew, and rotational movement correcting process, printing is performed without relative skew between the sheer M and the image printed on the sheet M. Step S217 is an example of a print controlling process.

(3-7-2) Exposure Timing, Skew, and Rotational Movement Correcting Process

Figure 10:
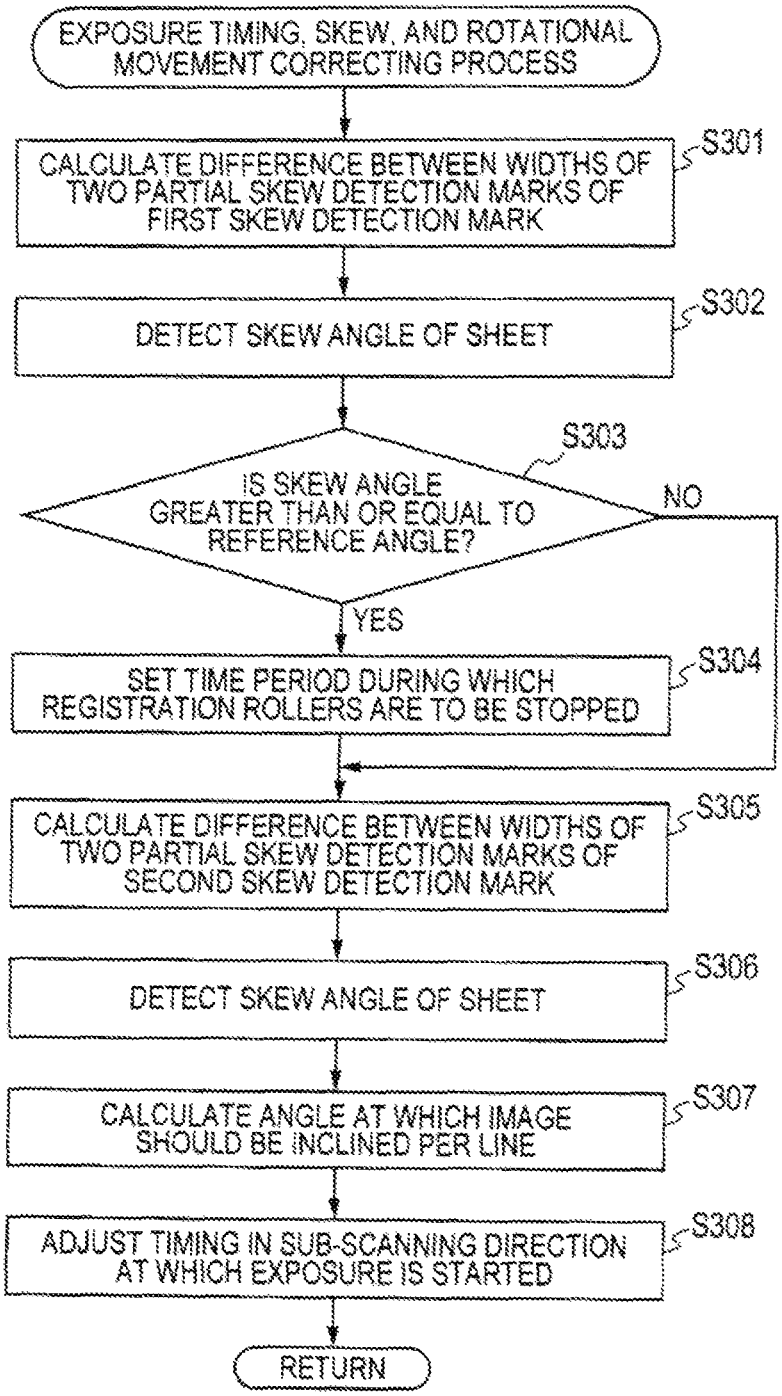
FIG. 10 is a flowchart showing the flow of an exposure timing, skew, and rotational movement correcting process.

Next, the exposure timing, skew, and rotational movement correcting process executed in S215 will be described while referring to FIG. 10. As described above, when the sheet M is skewed, skew may be corrected by adjusting a time period during which the registration rollers 36 are stopped, or may be corrected by printing an image while inclining the image relative to the skewed sheet M. Here, an example will be described for a case in which a time period during which the registration rollers 36 are slopped is adjusted.

In S301, the controller 80 calculates a difference between the width, in the sub-scanning direction, of the partial skew detection mark 90*a* constituting the first skew detection mark 90 and the width, in the sub-scanning direction, of the partial skew detection mark 90*b* also constituting the first skew detection mark 90, the widths being corrected in S213.

In S302, the controller 80 detects a skew angle of the sheet M based on the difference of the widths calculated in S301. Step S302 is an example of a skew-angle detection process and a first skew-angle detection process.

In S303, the controller 80 determines whether the skew angle detected in S302 is greater than or equal to a reference angle. If the skew angle is greater than or equal to the reference angle, the process proceeds to S304. If the skew angle is less than the reference angle, the process proceeds to S305.

In S304, the controller 80 determines a time period during which the registration rollers 36 are to be stopped, the time period being required to correct the skew angle detected in S302. Then, the controller 80 adds the determined time period to the current time period of stopping the registration rollers 36, and sets this time period as a time period of stopping the registration rollers 36 when the subsequent images axe printed. Step S304 is an example of a skew correction process.

In S305, the controller 80 calculates a difference between the width of the partial skew detection mark 91*a* of the second skew detection mark 91 in the sub-scanning direction and the width of the partial skew detection mark 91*b* in the sub-scanning direction, the widths being corrected in S214.

In S306, the controller 80 detects the skew angle of the sheet M based on the difference of the widths acquired in S305. Step S306 is an example of a second skew-angle detection process.

In S307, the controller 80 calculates a difference between the skew angle detected in S302 and the skew angle detected in S306 as a rotational angle of the sheet M while the sheet M is conveyed by the conveying belt 35, and divides the calculated rotational angle by the number of lines per sheet, thereby calculating an angle at which an image should be inclined per line. Then, the controller 80 sets the calculated angle as an angle at which an image should be inclined per line when the subsequent images are printed.

In S308, the controller 80 calculates the amount of misregistration of the image in the sub-scanning direction relative to the sheet M, based on the width of the partial skew detection mark 90*a* of the first skew detection mark 90 in the sub-scanning direction and the width of the partial skew detection mark 90*b* in the sub-scanning direction. And, based on the calculated amount of misregistration, the controller 80 adjusts timing in the sub-scanning direction at which the exposing section 41 starts exposure, so that the position of an image in the sub-scanning direction is not misaligned (shifted) relative to the sheet M when the subsequent images are printed.

(3-7-3) Normal Printing Process

Figure 9:
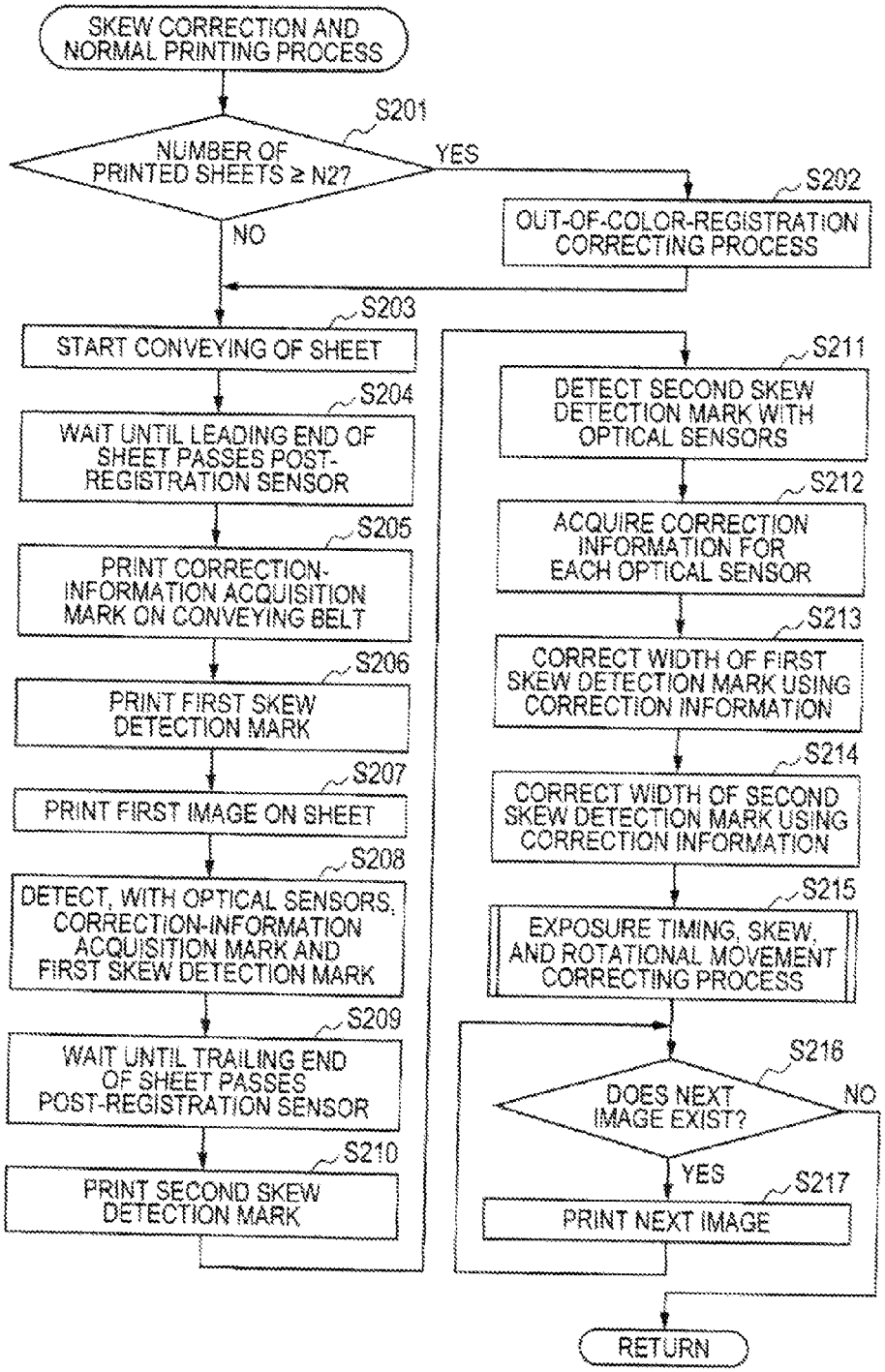
FIG. 9 is a flowchart showing the flow of a skew correction and normal printing process.

The above-mentioned normal printing process executed in S104 is substantially the same as the skew correction and normal printing process, except that steps S205, S206, S208, and S210-S215 are not executed in the flowchart in FIG. 9. Thus, descriptions are omitted.

(4) Advantageous Effects of the First Embodiment

According to the printer 1 of the above-described first embodiment, the skew detection mark 90 is printed at positions passing detection regions that are detected by the two optical sensors 70 different from each other, such that the skew detection mark 90 extends over the end portion of the sheet M in the sub-scanning direction and the outer peripheral surface of the conveying belt 35. Thus, the skew detection mark for detecting skew of the sheet M can be printed.

Further, according to the printer 1, the processing section closest to the registration rollers 36 prints the skew detection mark 90. Thus, when the sheet M is skewed, it is possible to determine that the skew is caused by insufficient skew correction by the registration rollers 36.

Further, according to the printer 1, the skew detection mark 90 consists of the plurality of partial skew detection marks 90*a* and 90*b* that are printed at positions spaced away in the main scanning direction. Hence, compared with a case where a single skew detection mark that is long in the main scanning direction is printed, developer used for printing the skew detection mark can be saved.

Further, according to the printer 1, the skew detection mark 90 is printed in the reference color. Thus, the print position of an image in the color of the skew detection mark 90 is not misaligned (shifted) relative to an image in the reference color.

Further, according to the printer 1, the skew angle of the sheet M is detected by comparing detection signals from the two optical sensors 70 and, based on the skew angle, relative skew between a sheet M and an image to be printed on the sheet M is corrected. Hence, skew of the image relative to the sheet M can be suppressed.

Further, according to the printer 1, the rotational angle of the sheet M conveyed by the conveying belt 35 can be detected based on skew (inclination) of the sheet M detected by the first skew detection mark 90 and skew (inclination) of the sheet M detected by the second skew detection mark 91.

Further, according to the printer 1, a single processing section prints the first skew detection mark 90 and the second skew detection mark 91. If the first skew detection mark 90 and the second skew detection mark 91 are printed by different processing sections, even if the sheet M does not rotationally move while being conveyed by the conveying belt 35, there is a possibility that an erroneous determination is made that the sheet M has rotationally moved due to a fact that those processing sections are inclined relative to each other. According to the printer 1, a single processing section prints the first skew detection mark 90 and the second skew detection mark 91, which can reduce a possibility that an erroneous determination is made that the sheet M has rotationally moved although the sheet M is not rotationally moved actually.

Further, according to the printer 1, a difference between a skew angle detected by the first skew detection mark 90 and a skew angle detected by the second skew detection mark 91 is calculated as the rotational angle of the sheet M while being conveyed by the conveying section 30 and, based on the calculated rotational angle, the image is printed while being rotated. Thus, even if the sheet M is rotationally moved, skew of the image relative to the sheet M can be suppressed.

Further, according to the printer 1, the correction-information acquisition mark 95 is detected by the optical sensors 70, and comparison is made between the width of the mark in the sub-scanning direction that is determined from detection signals from the optical sensors 70 and the reference width that is ideally detected. With this process, correction information for correcting detection signals from the optical sensors 70 can be acquired.

Further, according to the printer 1, if the number of sheets printed subsequent to previous detection of skew of the sheet M is less than the reference number N1 (S101: No), the correction-information acquisition mark 95 is not printed. This can shorten a time period that takes before printing on the sheet M is started. Step S101 is an example of a determining process. Further, "printing the correction-information acquisition mark 95 if the correction-information acquisition mark 95 is printed if the number of sheets is greater than or equal to the reference number N1" is an example of a predetermined criterion.

Second Embodiment

Figure 11:
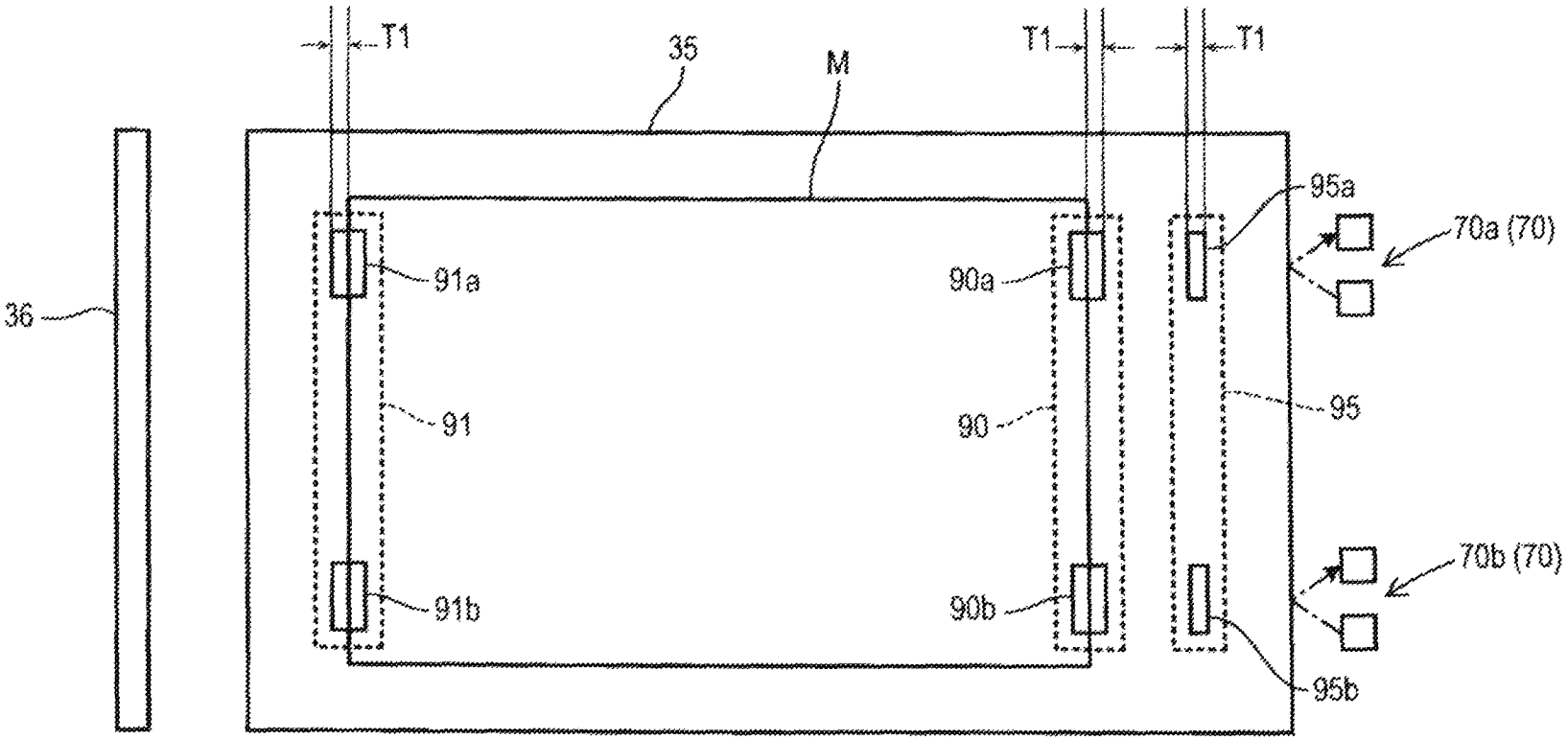
FIG. 11 is a schematic view showing a correction-information acquisition mark according to a second embodiment.

Next, a second embodiment will be described while referring to FIG. 11.

The controller 80 in the second embodiment prints the correction-information acquisition mark 95 such that a width of the correction-information acquisition mark 95 in the sub-scanning direction is the same as a width of a portion of a skew detection mark in the sub-scanning direction that is printed on the conveying belt 35, the width of the portion of the skew detection mark being a width in a ease where it is assumed that the sheet M is not skewed and that there is no relative misregistration in the sub-scanning direction between the skew detection mark 90, 91 and the sheet M.

Hereinafter, the embodiment will be described in greater detail while referring to FIG. 11. FIG. 11 shows a case where the sheet M is not skewed and there is no relative misregistration in the sub-scanning direction between the skew detection mark 90, 91 and the sheet M. When the width of the portion of the skew detection mark 90, 91 in the sub-scanning direction that is printed on the conveying belt 35 in this case is T1, the width of the correction-information acquisition mark 95 in the sub-scanning direction is also T1.

In the second embodiment, in S213 in the skew correction and normal printing process, the controller 80 calculates each width of the partial skew detection marks 90*a* and 90*b* of the first skew detection mark 90 in the sub-scanning direction, and adds correction information to the calculated width, thereby correcting the width. The same goes for S214.

According to the printer 1 in the above-described second embodiment, the process can be simplified because the width of the correction-information acquisition mark 95 in the sub-scanning direction is the same as the width of the portion of the skew detection mark in the sub-scanning direction that is printed on the conveying belt 35. This will be described in greater detail below.

If the width of the correction-information acquisition mark 95 in the sub-scanning direction is different from the width of the portion of the skew detection mark 90, 91 in the sub-scanning direction that is printed on the conveying belt 35, in order to correct the width of the portion of the skew detection mark 90, 91 in the sub-scanning direction that is printed on the conveying belt 35, in some cases, correction information acquired with the correction-information acquisition mark 95 should not be added simply, but correction information should be added after adjusting correction information based on a ratio of the width of the portion of the skew detection mark in the sub-scanning direction that is printed on the conveying belt 35 to the width of the correction-information acquisition mark 95 in the sub-scanning direction. However, with this method, a process of adjusting correction information is required, which increases the amount of processes.

In contrast, in the present embodiment, the width of the correction-information acquisition mark 95 in the sub-scanning direction is the same as the width of the portion of the skew detection mark 90, 91 in the sub-scanning direction that is printed on the conveying belt 35. Thus, even when the width of the portion of the skew detection mark 90, 91 in the sub-scanning direction that is printed on the conveying belt 35 varies, the difference between this varied width and the width of the correction-information acquisition mark 95 in the sub-scanning direction is not very large. Thus, correction can be made simply by adding the correction information. This prevents correction front becoming complicated when correcting the width of the skew detection mark 90, 91 in the sub-scanning direction that is determined from detection signals of the optical sensors 70.

Third Embodiment

Next, a third embodiment will be described.

In the above-described first embodiment, a case is described, as an example, in which the correction-information acquisition mark 95 is printed when the conveying belt 35 is rotated for printing an image specified by a user on the sheet M. In contrast, the controller 80 in the third embodiment rotates the conveying belt 35 and prints the correction-information acquisition mark 95 at different timing from when the conveying belt 35 is rotated for printing an image specified by the user on the sheet M.

Specifically, for example, in a standby state where printing of an image is not instructed by a user, the controller 80 rotates the conveying belt 35, prints the correction-information acquisition mark 95, and acquires correction information of each optical sensor 70. Then, the controller 80 stores the acquired correction information in the RAM 80*c* and, when printing of an image is instructed by the user, corrects detection signals of the optical sensors 70 using the stored correction information.

As described above, because in the third embodiment the correction-information acquisition mark 95 is printed in the standby state where printing of an image is not instructed by a user, step S205 is not executed in the skew correction and normal printing process shown in FIG. 9. Other than that, the flow of the skew correction and normal printing process in the third embodiment is the same as the flow of the skew correction and normal printing process shown in FIG. 9.

Note that a process of printing the correction-information acquisition mark 95 and acquiring correction information may be executed, for example, every time printing of an image specified by the user ends and the printer 1 shifts to the standby state, or may be executed when the power of the printer 1 is turned on, or may be executed when a certain time period has elapsed subsequent to previous acquisition of correction information and the printer 1 is in the standby state, or may be executed when the number of sheets greater than or equal to a reference number have been printed subsequent to previous acquisition of correction information and the printer 1 is in the standby state.

According to the printer 1 of the above-described third embodiment, the conveying belt 35 is rotated and the correction-information acquisition mark 95 is printed at different timing front when the conveying belt 35 is rotated for printing an image specified by the user on the sheet M. Hence, compared with a case in which the correction-information acquisition mark 95 is printed after printing of an image is instructed by a user and then the specified image is printed, a time period can be shortened, the time period being from when printing of an image is instructed by a user until when printing of the image is started.

Fourth Embodiment

Next, a fourth embodiment will be described while referring to FIG. 12.

In the above-described first embodiment, a case is described in which the partial skew detection marks 90*a* and 90*b* are both printed in black. In contrast the controller 80 in the fourth embodiment controls different processing section to print the two partial skew detection marks 90*a* and 90*b* constituting the single skew detection mark 90.

Further, the controller 80 in the fourth embodiment controls the same processing section to print the partial skew detection mark 90*a* and the partial correction-information acquisition mark 95*a* that passes the same detection position as a detection position which the partial skew detection mark 90*a* passes. Similarly, the controller 80 controls the same processing section to print the partial skew detection mark 90*b* and the partial correction-information acquisition mark 95*b* that passes the same detection position as a detection position which the partial skew detection mark 90*b* passes.

The embodiment will be described in greater derail while referring to FIG. 12. In the illustrated example, as to the first skew detection mark 90, one of the two partial skew detection marks constituting the skew detection mark 90 is K (black), and the other is Y (yellow). The same goes for the second skew detection mark 91.

Figure 12:
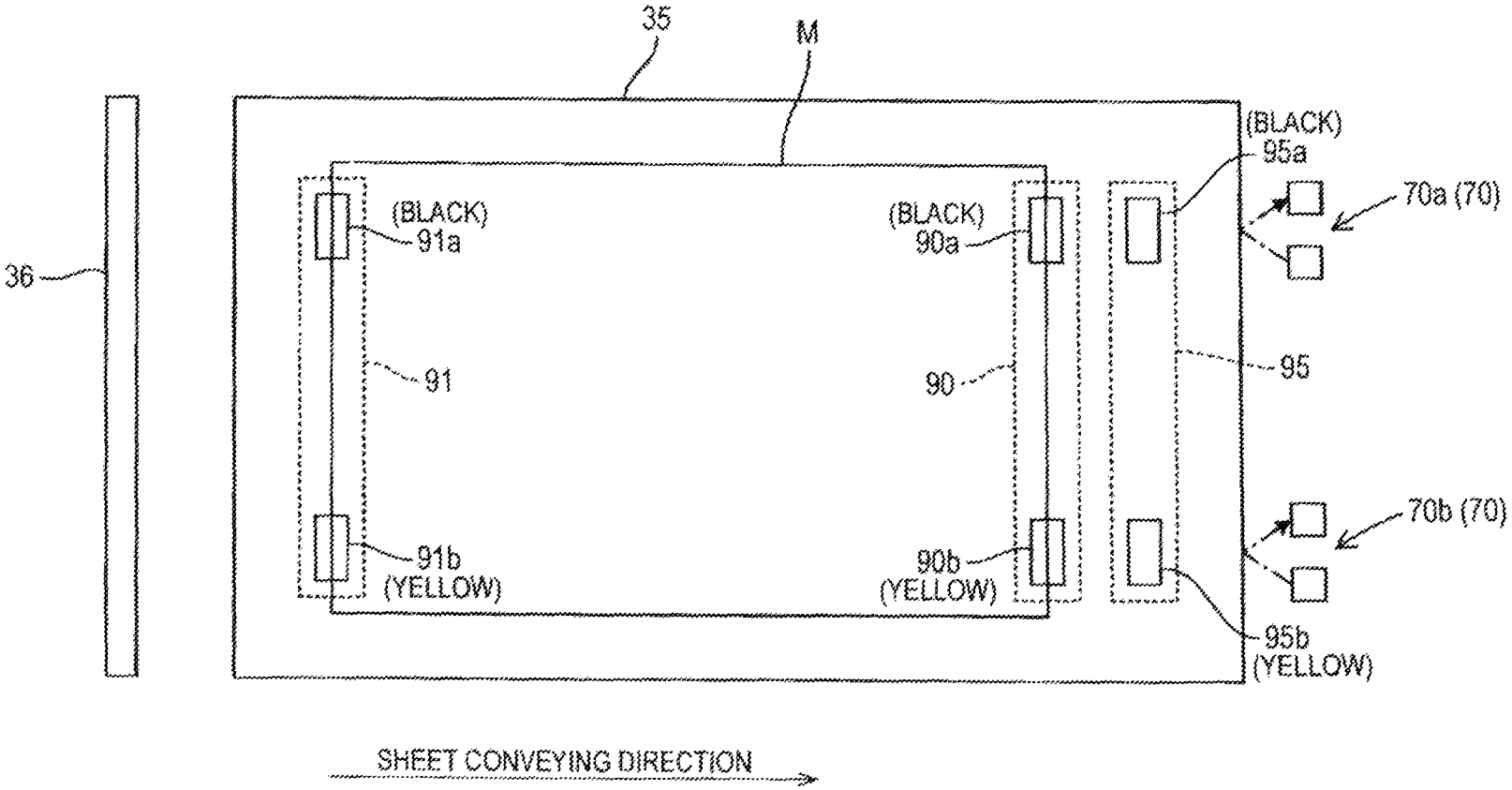
FIG. 12 is a schematic view showing a skew detection mark according to a fourth embodiment.

Further, as shown in FIG. 12, of the two partial correction-information acquisition marks 95*a* and 95*b* constituting the correction-information acquisition mark 95, the partial correction-information acquisition mark 95*a* is K (black), and the partial correction-information acquisition mark 95*b* is Y (yellow).

As shown in FIG. 12, the skew detection mark 90*a* and the partial correction-information acquisition mark 95*a* that are detected by the optical sensor 70*a* are both K (black). Similarly, the skew detection mark 90*b* and the partial correction-information acquisition mark 95*b* that are detected by the optical sensor 70*b* are both Y (yellow).

When the first skew detection mark 90 is printed in S206 in the skew correction and normal printing process, the controller 80 in the fourth embodiment controls the printing section 40 to print the partial skew detection mark 90*a* (one of the skew detection mark 90) in K (black) and to print the partial skew detection mark 90*b* (the other one of the skew detection mark 90) in Y (yellow), as described above. The same goes for the step of printing the second skew detection mark 91 in S210. Further, when the correction-information acquisition mark 95 is printed in S205 in the skew correction and normal printing process, the controller 80 controls the printing section 40 to print the partial correction-information acquisition mark 95*a* (one of the correction-information acquisition mark 95) in K (black) and to print the partial correction-information acquisition mark 95*b* (the other one of the correction-information acquisition mark 95) in Y (yellow), as described above.

According to the printer 1 in the above-described fourth embodiment, the plurality of partial skew detection marks 90*a* and 90*b* constituting the single skew detection mark 90 are printed by the processing section different from each other. This suppresses the amount of consumption of toner in a certain color from becoming large.

Further, according to the printer 1, variability in detected width can be reduced. Specifically, even though it is intended to detect the same mark, detected width may vary due to various reasons such as degradation condition of toner, transfer condition of each processing section, developing condition, exposure intensity, or the like. In the fourth embodiment, however, because the same processing section prints the partial skew detection mark 90*a* and the partial correction-information acquisition mark 95*a* that passes the same detection position as a detection position which the partial skew detection mark 90*a* passes, variability in detected width due to the above reasons can be reduced.

Modifications

While the invention has been described in detail with reference to the above aspects thereof, it would be apparent to those skilled in the art that various changes and modifications may be made therein without departing from the scope of the claims.

(1) In the above-described embodiments, the skew detection marks 90 and 91 are printed on both of the leading end portion and the trailing end portion of a sheet. Alternatively, the skew detection mark may be printed only one of the leading end portion and the trailing end portion of a sheet.

(2) In the above-described embodiments, the skew detection mark 90 is printed on a sheet on which an image specified by the user is printed. Alternatively, the skew detection mark 90 may be printed on a sheet that is different from a sheet on which an image specified by the user is printed.

(3) In the above-described embodiments, the printer 1 has the two optical sensors 70. Alternatively, the printer 1 may have three or more optical sensors 70.

(4) In the above-described embodiments, the printer 1 is a color printer that is configured to print color images. Alternatively, the printer may be a monochromatic printer that is configured to print monochromatic images.

(5) In the above-described embodiments, the single skew detection mark 90 consists of the plurality of partial skew detection marks 90*a* and 90*b*. Alternatively, the skew detection mark 90 may be printed as a single mark extending in the main scanning direction.

(6) In the above-described embodiments, the controller 80 includes the single CPU 80*a*. Alternatively, the controller 80 may be constituted by a plurality of CPUs 80*a*, may be constituted by an ASIC, or may be constituted by a combination of one or more CPU and ASIC. Also, the above-described functions of the controller 80 may be executed by software, hardware, or a combination of software and hardware.

(7) In the above-described embodiments, the printer 1 is described as an example of a printing apparatus. Alternatively, the printing apparatus may be a so-called multifunction peripheral (MFP) having a printer function, a scanner function, a facsimile function, a copier function, and the like.

What is claimed is:

1. A printing apparatus comprising:

a conveying device having a conveying belt configured to convey a sheet, the conveying belt having an outer peripheral surface;

a printing device configured to print an image on the sheet that is conveyed by the conveying device in a conveying direction;

a plurality of sensors arranged to be spaced away from each other in a main scanning direction that is perpendicular to the conveying direction, the plurality of sensors configured to emit light to different detection regions on the outer peripheral surface of the conveying belt and to receive light reflected by the conveying belt; and a controller configured to execute a skew-detection-mark printing process of controlling the printing device to print a skew detection mark at positions passing the respective detection regions such that the skew detection mark extends over an end of the sheet in the conveying direction and the outer peripheral surface of the conveying belt.

2. The printing apparatus according to claim 1, wherein the printing apparatus is configured to print a color image;

wherein the conveying device comprises a skewing correction roller that is provided at an upstream side of the conveying belt in a conveying path of the sheet and that is configured to correct skewing of the conveyed sheet;

wherein the printing device comprises a plurality of processing sections that is configured to print an image with developer; and wherein the controller is configured to control a processing section closest to the skewing correction roller to print the skew detection mark in the skew-detection-mark printing process.

3. The printing apparatus according to claim 1, wherein the skew detection mark comprises a plurality of partial skew detection marks that is printed at positions spaced away from each other in the main scanning direction.

4. The printing apparatus according to claim 3, wherein the printing apparatus is configured to print a color image;

wherein the printing device comprises a plurality of processing sections that is configured to print an image with developer; and wherein the controller is configured to control the plurality of processing sections so that the plurality of partial skew detection marks is printed by processing sections different from each other.

5. The printing apparatus according to claim 1, wherein the printing apparatus is configured to print a color image;

wherein the printing device comprises a plurality of processing sections that is configured to print an image with developer;

wherein the controller is configured to execute:

a misregistration-correction-mark printing process of controlling the printing device to print misregistration correction marks on the outer peripheral surface of the conveying belt;

a misregistration-amount detection process of controlling the plurality of sensors to detect each of the misregistration correction marks printed in the misregistration-correction-mark printing process, and detecting a relative amount of misregistration of a misregistration correction mark in one color relative to a misregistration correction mark that is printed in a predetermined reference color; and a misregistration correction process of correcting a print position of an image printed in the one color relative to an image printed in the reference color based on the relative amount of misregistration detected in the misregistration-amount detection process, thereby correcting relative misregistration of the images in each color; and wherein the controller is configured to control the printing device to print the skew detection mark in the reference color in the skew-detection-mark printing process.

6. The printing apparatus according to claim 1, wherein the controller is configured to execute:

a skew-angle detection process of comparing detection signals outputted from the plurality of sensors and detecting a skew angle of the sheet; and a skew correction process of correcting relative skew between the sheet and an image printed on the sheet based on the skew angle detected in the skew-angle detection process.

7. The printing apparatus according to claim 1, wherein, in the skew-detection-mark printing process, the controller is configured to control the printing device to print a first skew detection mark to extend over a leading end portion of the sheet and the outer peripheral surface of the conveying belt and to print a second skew detection mark to extend over a trailing end portion of the sheet and the outer peripheral surface of the conveying belt.

8. The printing apparatus according to claim 7, wherein the controller is configured to execute:

a first skew-angle detection process of detecting the first skew detection mark with the plurality of sensors, and of comparing detection signals outputted from each of the plurality of sensors to detect a first skew angle of the sheet;

a second skew-angle detection process of detecting the second skew detection mark with the plurality of sensors, and of comparing detection signals outputted from each of the plurality of sensors to detect a second skew angle of the sheet; and a print controlling process of calculating a difference between the first skew angle and the second skew angle as a rotational angle of the sheet during a period in which the sheet is conveyed by the conveying device, and of printing an image while rotating the image based on the calculated rotational angle.

9. The printing apparatus according to claim 1, wherein the printing apparatus is configured to print a color image;

wherein the printing device comprises a plurality of processing sections that is configured to print an image with developer; and wherein, in the skew-detection-mark printing process, the controller is configured to control the same processing section to print a first skew detection mark and a second skew detection mark, the first skew detection mark being printed to extend over a leading end portion of the sheet and the outer peripheral surface of the conveying belt, the second skew detection mart being printed to extend over a trailing end portion of the sheet and the outer peripheral surface of the conveying belt.

10. The printing apparatus according to claim 1, wherein the controller is configured to execute a correction-information-acquisition-mark printing process of controlling the printing device to print a correction-information acquisition mark at positions on the outer peripheral surface of the conveying belt passing through the respective detection regions, the correction-information acquisition mark being used for correcting detection signals of the plurality of sensors.

11. The printing apparatus according to claim 10, wherein a width of the correction-information acquisition mark in the conveying direction is the same as a width in the conveying direction of a portion of the skew detection mark printed on the conveying belt, assuming that the sheet is unskewed and that there is no relative misregistration in the conveying direction between the skew detection mark and the sheet.

12. The printing apparatus according to claim 10, wherein the controller is configured to execute a determining process of determining whether to acquire the correction information based on a predetermined criterion; and wherein, when it is determined in the determining process that the correction information is not to be acquired, the controller does not execute the correction-information-acquisition-mark printing process.

13. The printing apparatus according to claim 10, wherein the controller is configured to rotate the conveying belt at timing different from when the conveying belt is rotated to print an image specified by a user on the sheet, and to control the printing device to print the correction-information acquisition mark.

14. The printing apparatus according to claim 10, wherein the printing apparatus is configured to print a color image;

wherein the printing device comprises a plurality of processing sections that is configured to print an image with developer;

wherein the skew detection mark comprises a plurality of partial skew detection marks that is printed at positions spaced away from each other in the main scanning direction;

wherein the correction-information acquisition mark comprises a plurality of partial correction-information acquisition marks that is printed at positions spaced away from each other in the main scanning direction; and wherein the controller is configured to control the plurality of processing sections so that the plurality of partial skew detection marks is printed by processing sections different from each other, and to control the plurality of processing sections so that one of the plurality of partial skew detection marks and a corresponding one of the plurality of partial correction-information acquisition marks are printed by the same processing section, the corresponding one of the plurality of partial correction-information acquisition marks passing the same detection region as a detection region which the one of the plurality of partial skew detection marks passes.

* * * * *